United States Patent [19]

Wu

[11] Patent Number: 4,881,350

[45] Date of Patent: Nov. 21, 1989

[54] ANTI-EARTHQUAKE STRUCTURE INSULATING THE KINETIC ENERGY OF EARTHQUAKE FROM BUILDINGS

[76] Inventor: Chyuang-Jong Wu, 15, lane 47, Ta Tung Rd., Fay Sha Tsun, Sze Hu Hsiang, Yun Lin Hsien, Taiwan

[21] Appl. No.: 334,606

[22] Filed: Apr. 6, 1989

[30] Foreign Application Priority Data

Apr. 25, 1988 [JP] Japan ..... 63-102315

[51] Int. Cl.[4] ..... F16M 13/00; E04H 9/02

[52] U.S. Cl. ..... 52/167 R; 248/580; 248/584

[58] Field of Search ..... 52/167; 248/580, 584

[56] References Cited

U.S. PATENT DOCUMENTS

| | | | |
|---|---|---|---|
| 99,973 | 2/1870 | Touaillon | 52/167 |
| 951,028 | 3/1910 | Schär | 52/167 |
| 1,761,659 | 6/1930 | Cummings | 52/167 |
| 4,517,778 | 5/1985 | Nicolai | 52/167 |
| 4,617,769 | 10/1966 | Fyfe et al. | 52/167 |
| 4,726,161 | 2/1988 | Yaghoubian | 52/167 |

FOREIGN PATENT DOCUMENTS

| | | | |
|---|---|---|---|
| 573047 | of 1958 | Italy | 52/167 |
| 1260456 | 9/1986 | U.S.S.R. | 52/167 |

*Primary Examiner*—David A. Scherbel
*Assistant Examiner*—Anthony W. Williams

[57] ABSTRACT

An anti-earthquake structure insulating the kinetic energy of earthquake from buildings, which is constructed between a building and the construction site thereof, including a plurality of supporting layers having multiple ball seats, plural ball members correspondingly disposed on and pressed between said ball seats with extremely small rolling friction thereagainst, and a plurality of sliding block linkages disposed between the building and the supporting layers, whereby horizontal displacement of the construction site can apply no horizontal force to the supporting layers, and consequently, the building will remain stable and rigid, the sliding block linkages further converting vertical wobbling force into horizontal force, permitting the horizontal force to be absorbed by multiple buffer springs via lever devices.

12 Claims, 8 Drawing Sheets

ANTI-EARTHQUAKE STRUCTURE INSULATING THE KINETIC ENERGY OF EARTHQUAKE FROM BUILDINGS

BACKGROUND OF THE INVENTION

The earthquake has been an extremely destructive disaster long since. Although the architectural techniques and materials are greatly improved nowadays, the anti-earthquake design of a building still remains impractical without advanced development.

A conventional anti-earthquake design adopts reinforcing structure which stabilizes the building fixedly constructed on the ground. However, the energy produced by an earthquake is so unexpectedly huge that hardly can any reinforcing structure ever resist the extremely damaging force caused by an earthquake.

It is thought by the applicant that we can not fight with the earthquake but try to "insulate" the building from being affected by the earthquake. Therefore the present invention is developed by the applicant to eliminate the existing disadvantages in the conventional anti-earthquake design for buildings. According to the present invention, a plurality of supporting layers, the upper and lower surfaces of which are provided with multiple ball seats, and a plurality of corresponding ball members disposed on and pressed between the ball seats are constructed between a building and the construction site thereof, whereby the wobbling force of an earthquake are insulated from affecting the building via the extremely small rolling friction of the ball members against the supporting layers, and thus the building is kept static and stable without horizontal wobbling movement.

BRIEF DESCRIPTION OF THE DRAWINGS

FIG. 6-1 is an enlarged longitudinal sectional view taken on line D—D in FIG. 6, showing the sliding block and guide rail of the present invention;

DETAILED DESCRIPTION OF THE PREFERRED EMBODIMENTS

Figure 1:
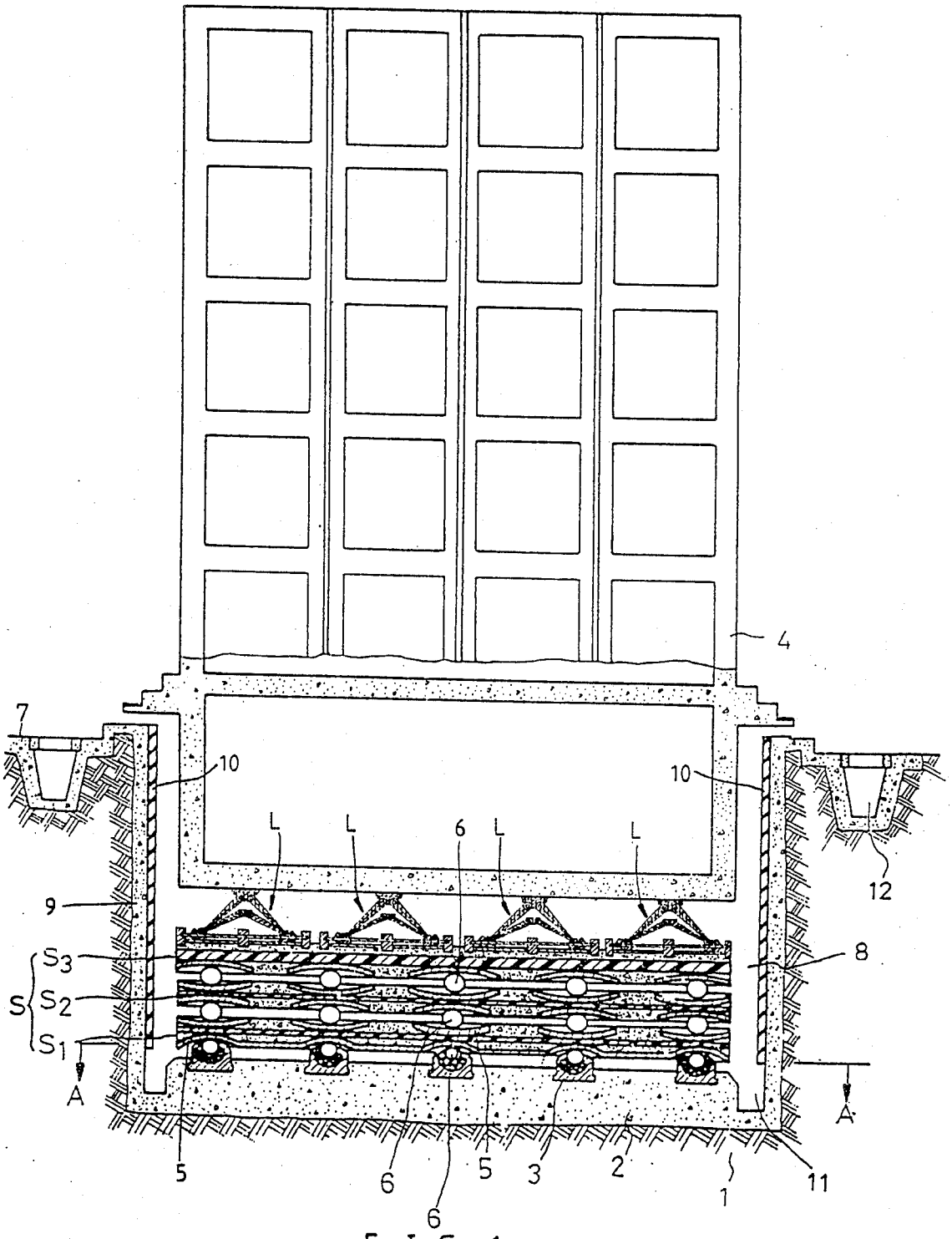
FIG. 1 is a longitudinal sectional view of the present invent constructed under a building.

Please first refer to FIG. 1 showing an anti-earthquake structure of the present invention, constructed between a building (4) and a construction site (2). A plurality of ball bearings (3) are fixedly constructed on the construction site (2) to support a first set of ball member (6). A first supporting layer ($S_1$), both upper and lower surfaces of which are equipped with plural curved ball seats (5), is disposed upon the first ball members (6) with the same pressed between the ball bearings (3) and the ball seats (5) on the lower surface of the first supporting layer ($S_1$). Then, a second set of ball members (6) can be disposed on the ball seats (5) on the upper surface of the first supporting layer ($S_1$), and a second supporting layer ($S_2$) like the first supporting layer ($S_1$) can be further disposed on the second set of ball members (6). Similarly, a third set of ball members (6) and a third supporting layer ($S_3$) can be arranged according to the preceding procedure, whereby because the rolling friction between the ball members (6) and ball seats (5) is extremely small, thus even when an earthquake occurs, the wobbling construction site (2) can hardly transmit any kinetic energy to the supporting layer ($S_1$), ($S_2$), and ($S_3$), and, as a consequence, the building (4) can hardly be affected by the earthquake and will remain stable and rigid.

Furthermore, a set of sliding block linkages (L) are provided between the third supporting layer ($S_3$) and the base room of the building (4). The sliding block linkages (L) are used to absorb possible vertical oscillating energy caused by the earthquake to protect the building (4) from vertical impact. The sliding block linkages (L) will be described in detail hereafter.

Figure 3:
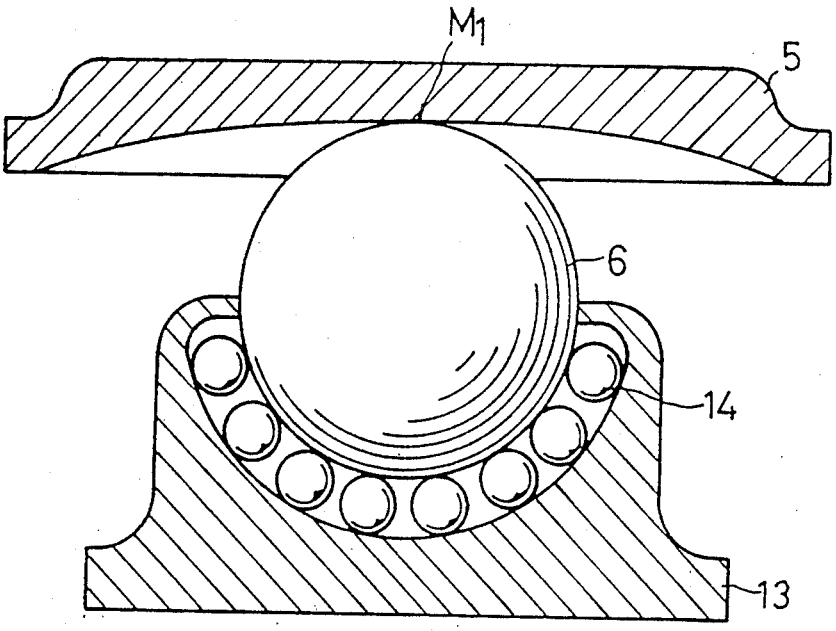
FIG. 3 is an enlarged longitudinal sectional view of the ball member and ball seat of the present invention.
Figure 4:
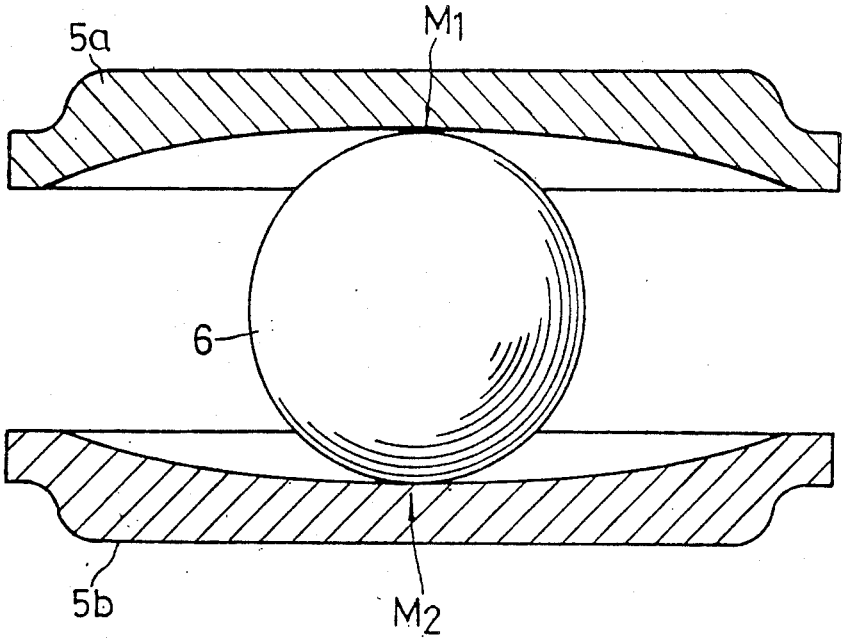
FIG. 4 shows another ball member and ball seat of the present invention.

Now please refer to FIG. 3 and FIG. 4. The ball members (6), ball bearings (3) and ball seats (5) are exactly shaped and made from extremely rigid material. Additionally, their sufaces are extremely smooth, and therefore the rolling friction between them is extremely small, whereby the horizontal displacement of the construction site (2) caused by an earthquake will not result in any considerable corresponding horizontal displacement of the building (4).

Figure 2:
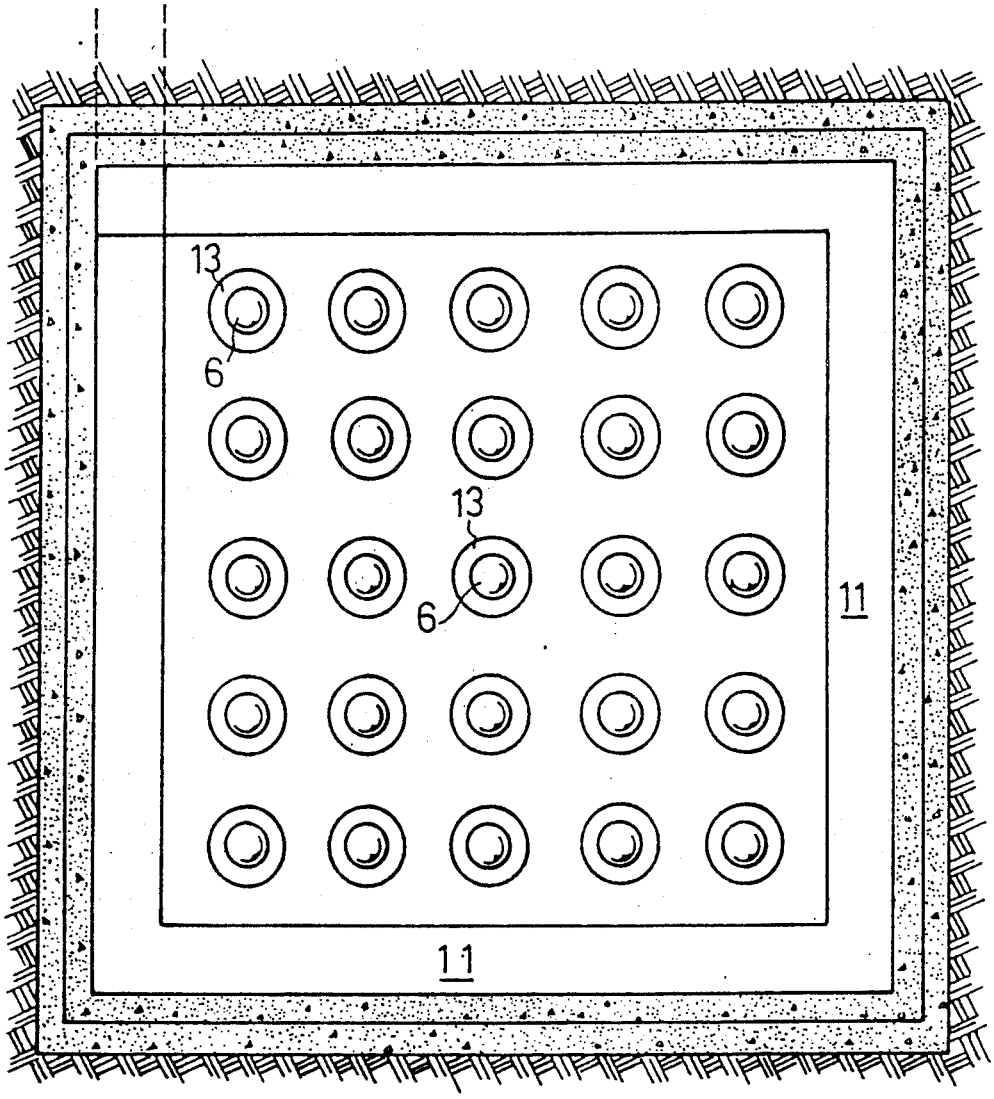
FIG. 2 is a top elevation of the present invention taken on A—A line in FIG. 1.

With reference to FIG. 2, the building (4) is evenly supported by a plurality of ball members (6) and ball seats (5) to distribute the weight of the building (4) over these ball members (6) and ball seats (5).

Referring again to FIG. 1, the construction site (2) is built in a recess (8) below the site line (7), and spaced from the walls (9) of the recess (8) at a certain distance. In addition, a set of buffer rubber elements (10) (or other similar elastic buffer means like spring or tire) are mounted on the walls (9) of the recess (8) to absorb impacting energy in case of an excessive horizontal displacement of the building (4) relative to the construction site (2). Several drainages (12), (11) are arranged around the recess (8) to drain the rainwater and protect the ball bearings (3) and other devices from contamination. As shown in FIG. 3, the ball bearing (3) includes a seat body (13) and plural bearing balls (14) disposed on the seat body (13). The ball member (6) is supported right upon the bearing balls (14) with extremely small rolling friction. The ball seat (5) has a curved recess surface, whereby in normal state or when the earthquake is over, the building (4) will be in its lowest position with the top of the ball member (6) kept in contact with the central point of the ball seat (5). The curved recess surface allows the building (4) to automatically return to its normal lowest position after the earthquake.

FIG. 4 shows a ball member (6) pressed between the curved upper ball seat (5*a*) and lower ball seat (5*b*). Also, when an earthquake is over, the ball member (6) will naturally roll back to its original position, i.e., a position contacting the highest point ($M_1$) of the curved recess surface (5*a*) and the lowest point ($M_2$) of the curved recess surface (5*b*).

Figure 5:
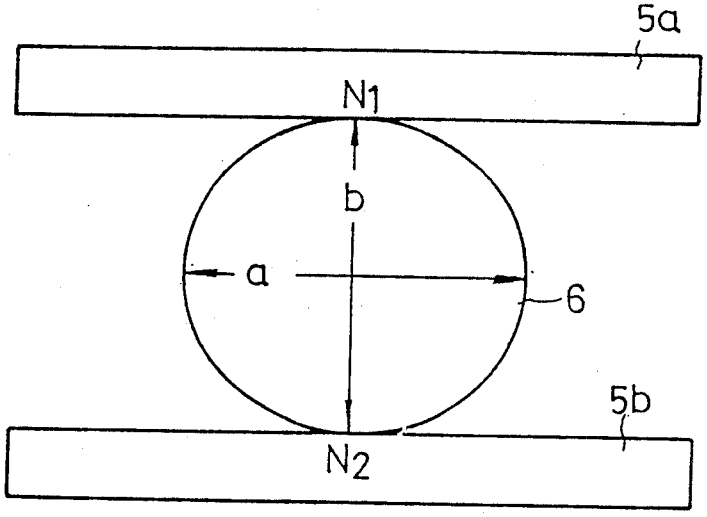
FIG. 5 shows an ellipsoid member and a plane seat thereof.

FIG. 5 shows another embodiment of the ball member (6) and ball seat (5). A ball member (6) in the ellipsoidal shape having major axis (a) and minor axis (b) is pressed between two plane ball seats (5*a*) and (5*b*). When an earthquake is over, two ends of the minor axis (b) of the ellipsoid will contact the plane ball seats (5*a*) and (5*b*).

The above-mentioned three types of ball members (6) and ball seats (5) all can make the building (4) automatically return to its original lowest and most stable position. The curvature of the ball seat (5) can determine the rolling resistance of the ball member (6). The larger the curvature is, the greater the resistance appears, but the more reliable the returning of building (4) is. The design of the curvature of the ball seat (5) depends on practical requirements. Similarly, as shown in FIG. 5, the larger difference between major and minor axes (a), (b) of the ellipsoidal ball member (6) will cause a greater resistance to itself.

Figure 6:
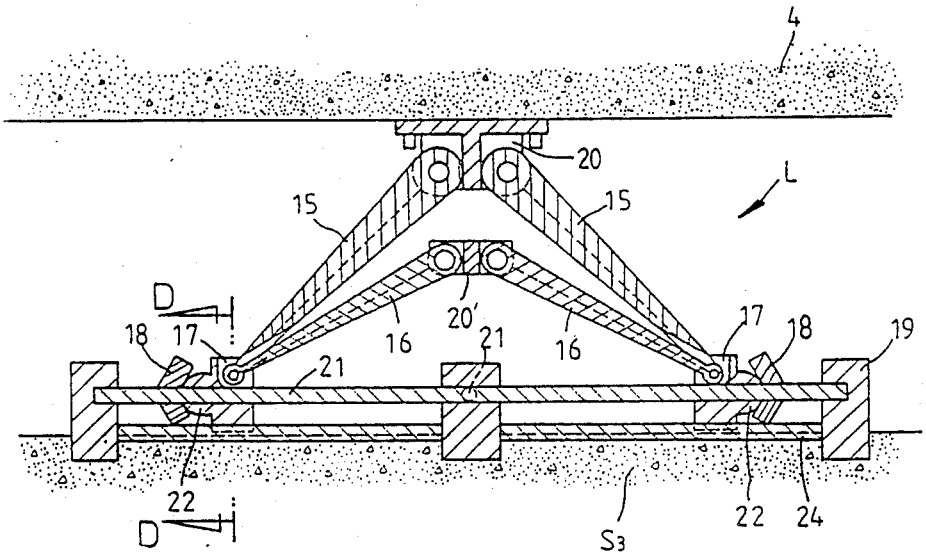
FIG. 6 is a longitudinal sectional view of the sliding block linkages taken on line C—C in FIG. 7.
Figure 7:
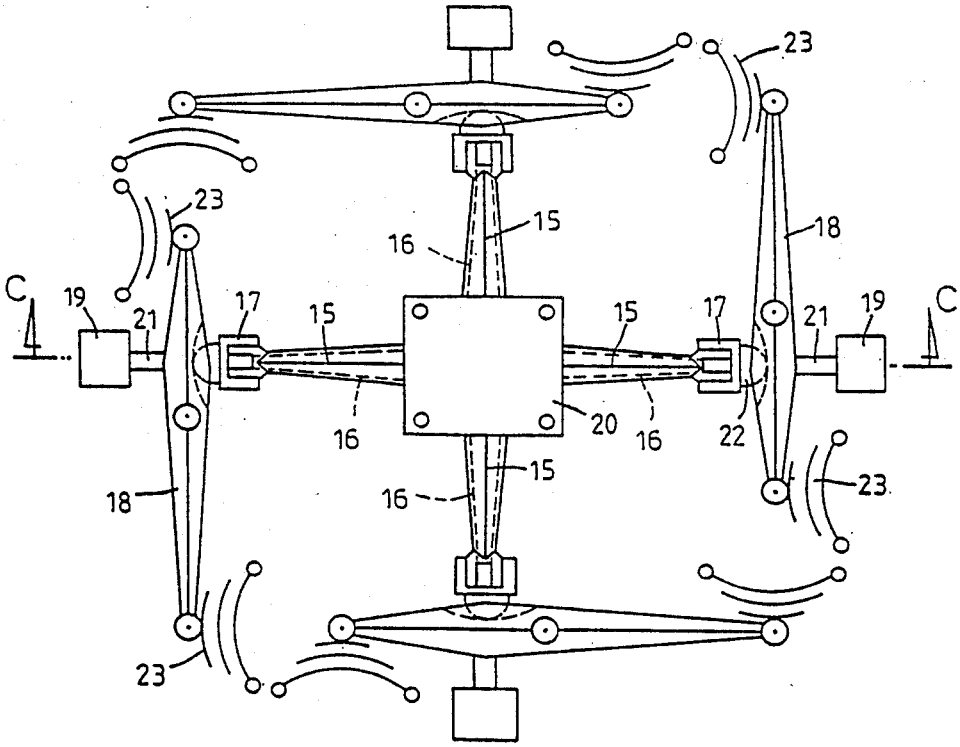
FIG. 7 is a top elevation of the sliding block linkages of the present invention.
Figures 1, 6:
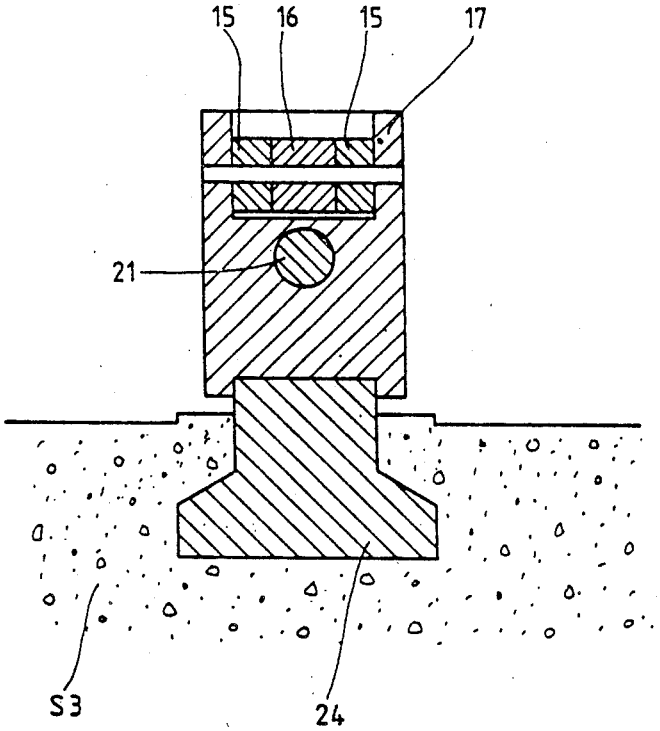

Further referring to FIGS. 6, 6-1, and 7, the sliding block linkage (L) of the present invention includes four first linkage bars (15) pivoted on a first pivot block (20) mounted on the lower surface of the building (4), and four second linkage bars (16) pivoted on a second pivot block (20). Each first linkage bar (15) and second linkage bar (16) are pivoted on a sliding block (17) at their other ends, the sliding block (17) being slidably guided by a guide rod (21) and a guide rail (24) disposed on the supporting layer ($S_3$) in parallel with the guide rod (21). The sliding block (17) is restricted by a lever (18), two ends of which are respectively opposed to two buffer leaf bending springs (23). Additionally, a stopper block (19) is provided behind the lever (18) to prevent possible excessive load on the leaf bending springs (23).

The principle of lever is applied to the lever (18) wherein the distance between the sliding block (17) and the fulcrum of the lever (18) is smaller than those between the leaf bending springs (23) and the fulcrum of the lever (18), and thus the leaf bending springs (23) can bear many times the force transmitted from the sliding block (17).

When a vertical wobbling force is produced by an earthquake, or converted from the rolling movement of the ball members (6) on the curved recess ball seats (5), this vertical vibrating force will be converted into horizontal force through the link motion of the sliding block linkages (L) and absorbed by the buffer leaf bending springs (23) via the lever motion of the levers (18).

Figure 8:
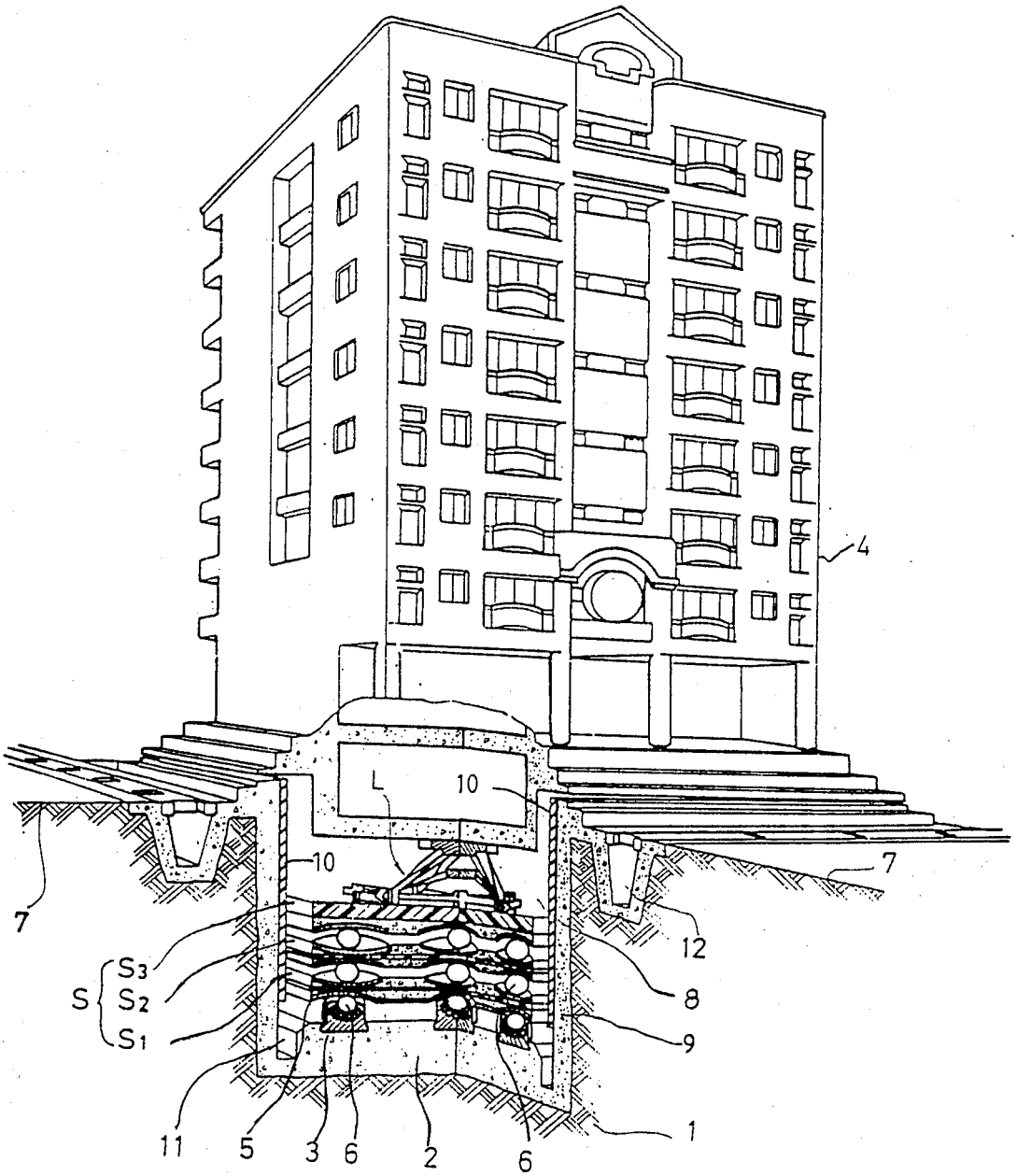
FIG. 8 is a partially sectional perspective view of the present invention constructed under a building.

As shown in FIG. 1 and FIG. 8, the multiple supporting layers ($S_1$), ($S_2$), and ($S_3$) help that the horizontal wobbling energy transmitted from the construction site (2) to the building (4) will be upward reduced layer by layer by geometric progression. The final energy reaching the building (4) will be negligibly small, and therefore the building (4) is protected from damage or crack.

In a typhoon or hurricane zone, multiple anchor blocks can be constructed around or under the building, and by means of corresponding steel cables or chains, the building (4) can be connected with the anchor blocks and limited within an allowable space range to avoid excessive affection of heavy wind or storm.

While the pipe lines (such as electrical wiring, water pipe line, etc.) disposed between the building (4) and the earth crust (1) can employ extensive pipes or S-shaped elastic pipes to avoid break or pipe lines caused by displacement of the construction site (2) relative to the building (4).

I claim:

1. An anti-earthquake structure constructed between a building and the construction site thereof, comprising:

a plurality of supporting layers having upper and lower surfaces, both said upper and lower surfaces being provided with multiple ball seats;

a plurality of ball members correspondingly disposed on and pressed between said ball seats with extremely small rolling friction thereagainst;

a plurality of sliding block linkages disposed between the building and said supporting layers, said linkages including pivot blocks, multiple linkage bars pivoted on said pivot block, sliding blocks on which said linkage bars are pivoted, and guide means guiding said sliding blocks;

levers each having two ends and a fulcrum, to which said sliding block is opposed; and buffer springs opposed to said lever for absorbing kinetic energy transmitted from said sliding blocks via lever motion.

2. A structure as claimed in claim 1, wherein said ball members and ball seats are made from extremely rigid material, permitting the rolling friction therebetween to be extremely small, whereby when horizontal displacement of the construction site occurs due to an earthquake, said ball members will only roll on said ball seats with negligible friction, and thus apply no horizontal force to said supporting layers, and consequently, the building constructed above said supporting layers will remain stable and rigid.

3. A structure as claimed in claim 1, further comprising a plurality of ball bearings each composed of a seat body and plural bearing balls disposed thereon, said ball bearings being mounted on the construction site to support said ball members.

4. A structure as claimed in claim 1, wherein each of said ball seat is provided with a curved recess surface having a central top point and said ball members are formed in a precisely spherical shape, whereby said ball members will contact said central top points of said ball seats in normal state, and, when an earthquake is over, said ball members will roll back automatically and contact said central top points, thus permitting the building to be always in a lowest, most stable position.

5. A structure as claim in claim 1, wherein said ball seats are formed in a plane shape, while said ball members are formed in an ellipsoidal shape having a minor axis with two ends.

6. A structure as claimed in claim 1, wherein said seats are formed in a curved recess shape and said ball members are formed in a ellipsoid shape.

7. A structure as claimed in claim 1, wherein said sliding block linkages each includes four first linkage bars each having two ends, a first pivot block, mounted under the building, on which one end of said first linkage bars are pivoted, four second linkage bars each also having two ends, and a second pivot block on which one end of said second linkage bars are pivoted, said first and second linkage bars being pivoted on said sliding blocks at their other ends, said guide means each including a guide rod and a guide rail, said sliding blocks being slidably guided by said guide means and restricted by said levers, said buffer springs being a kind of leaf bending springs and respectively disposed against said two ends of said levers.

8. A structure as claimed in claim 7, wherein the distances between said sliding blocks and said fulcrums of said levers are always smaller than those between said leaf bending springs and said fulcrums of said levers, and stopper means are further disposed behind said levers to prevent excessive displacement thereof.

9. A structure as claimed in claim 1, wherein said sliding block linkages are used to convert possible vertical wobbling force caused by an earthquake into horizontal force via linkage motion, said horizontal force then being absorbed by said buffer springs to protect the building from damage or crack.

10. A structure as claimed in claim 1, wherein said supporting layers include multiple supporting layers whereby the horizontally wobbling kinetic energy transmitted from the construction site is upward reduced in geometric progression layer by layer.

11. A structure as claimed in claim 5 or 6, wherein after an earthquake and ellipsoidal ball members will roll back automatically and said two ends of said minor axis of said ellipsoidal ball members will contact said plane ball seat and curved recess ball seat, permitting the building to be in a lowest, most stable position.

12. A structure as claimed in claim 4, wherein when said ball members roll on said curved recess ball seats, the horizontal movement will be partially converted in vertical movement, which is further converted into the horizontal sliding movement of said sliding blocks of said sliding block linkages via linkage motion thereof, the kinetic energy of the horizontal sliding movement of the sliding blocks being absorbed by said buffer springs via said lever and converted into the elastic potential energy.

* * * * *